US010092999B2

(12) United States Patent
Sohn

(10) Patent No.: US 10,092,999 B2
(45) Date of Patent: Oct. 9, 2018

(54) VISE GRIP PLIERS

(71) Applicant: Won Ho Sohn, Seoul (KR)

(72) Inventor: Won Ho Sohn, Seoul (KR)

( * ) Notice: Subject to any disclaimer, the term of this patent is extended or adjusted under 35 U.S.C. 154(b) by 191 days.

(21) Appl. No.: 15/305,386

(22) PCT Filed: Apr. 28, 2015

(86) PCT No.: PCT/KR2015/004231
§ 371 (c)(1),
(2) Date: Oct. 20, 2016

(87) PCT Pub. No.: WO2015/167209
PCT Pub. Date: Nov. 5, 2015

(65) Prior Publication Data

US 2017/0043455 A1 Feb. 16, 2017

(30) Foreign Application Priority Data

May 2, 2014 (KR) ..... 10-2014-0053484

(51) Int. Cl.

| | |
|---|---|
| ***B25B 7/12*** | (2006.01) |
| ***B25G 1/10*** | (2006.01) |
| ***B25B 7/08*** | (2006.01) |
| ***B25B 7/14*** | (2006.01) |

(52) U.S. Cl.
CPC ..... *B25B 7/12* (2013.01); *B25B 7/08* (2013.01); *B25B 7/14* (2013.01); *B25G 1/10* (2013.01)

(58) Field of Classification Search
CPC .... B25B 7/06; B25B 7/08; B25B 7/12; B25B 7/14; B25G 1/10
See application file for complete search history.

(56) References Cited

U.S. PATENT DOCUMENTS

| | | | | |
|---|---|---|---|---|
| 4,651,598 | A | 3/1987 | Warheit | |
| 6,202,517 | B1 * | 3/2001 | Dolan | B25B 7/02 81/418 |
| 2012/0291293 | A1 * | 11/2012 | Nashimoto | B25B 7/00 30/272.1 |

FOREIGN PATENT DOCUMENTS

| | | | |
|---|---|---|---|
| KR | 900008894 | B1 | 12/1990 |
| KR | 1999-0080401 | A | 11/1999 |
| KR | 200206608 | Y1 | 12/2000 |

(Continued)

OTHER PUBLICATIONS

Jul. 6, 2015 International Search Report issued in International Patent Application No. PCT/KR2015/004231.

(Continued)

*Primary Examiner* — David B Thomas
(74) *Attorney, Agent, or Firm* — Paratus Law Group, PLLC

(57) ABSTRACT

Vise grip pliers capable of stably clamping an object with a simpler structure than that of normal vise pliers and also providing a vise grip function by means of a simple operation. To this end, the present invention has first and second jaws formed at the front end of a body, forms a space in which a ring pin can be provided, by outwardly bending handles, and then rebending the same without extending the handles immediately after hinge parts cross each other, in addition to, one hinge crossing the jaws in an X-shape by a hinge pin (P), and ensures the vise grip function by providing a tapered ring in the ring pin space, and then recrossing the handles in an X shape.

10 Claims, 4 Drawing Sheets

(56) References Cited

FOREIGN PATENT DOCUMENTS

| | | | |
|---|---|---|---|
| KR | 2006-0042307 | A | 5/2006 |
| KR | 200420379 | Y1 | 7/2006 |

OTHER PUBLICATIONS

Nov. 8, 2016 International Preliminary Report on Patentability issued in International Patent Application No. PCT/KR2015/004231.

* cited by examiner

VISE GRIP PLIERS

TECHNICAL FIELD

The present invention relates to vise grip pliers which are configured in a simplified structure and are able to stably and surely bite, for example, a flat, angular or rounded object, while carrying out a vise grip function through a simplified operation.

BACKGROUND ART

Typical pliers are configured in an X-shape, wherein upper and lower bodies are assembled though a hinge pin, and when a user grips both handles with a predetermined griping strength, the front jaws bite an object. The user needs to keep gripping the handles in order for the object to be held bitten for a predetermined time.

Meanwhile, the vise pliers are being called, for example, a vise grip, vise grip pliers, etc. and are able to keep biting the object for a long time.

The vise grip pliers use an adjusting screw installed at a first or second handle so as to adjust the interval between the first and second jaws which are configured to bite a processed object. For this reason, an interval adjustment may cause inconvenience, and the whole configuration (three hinges, a spring, a support member, an adjusting screw and a shaft) may be complicated and look rough. The weight thereof may be heavy, and a manufacturing cost may increase.

The conventional vise grips having such conveniences have been used in the industrial field for a long time in a state where new vise grip pliers are not disclosed, which are able to provide convenient and simplified functions while maintaining a conventional plier function.

For this reason, the related industry needs to develop new vise grip pliers which have a simplified configuration as well as a natural vise function in addition to a basic function which is set to allow a predetermined object to be bitten by jaws after both handle bodies have been restricted in a typical hinge way.

In recent years, a vise grip having diversified functions is being used.

For example, the patent document 1 describes a device equipped with a function to clamp a work target as well as a function, for example, a hitting function, a cutting function, and a claw hammer function, thus promoting conveniences.

The aforementioned patent document 1 (the Korean patent laid-open number 10-1999-0080401) have the disadvantages wherein it may provide multiple functions, but an abnormal function may occur due to the abrasion of each hinge pin after a long time use since a plurality of hinge pin connection structures are adapted, and an elastic member is deformed after a long time use since the elastic member (a spring) providing a recovery force and a link rotation function support member are employed, and a manufacturing cost may rise due to the use of an adjusting scree configured to support a side end of the support member and a complicated configuration, and a long time use is not available, and it necessarily needs to adjust an adjusting screw during a clamping operation so as to clamp a predetermined object in response to the thickness of a processed object, which may cause a complicated procedure for each required operation.

DISCLOSURE OF INVENTION

Accordingly, it is an object of the present invention to provide vise grip pliers which are able to provide a combined plier and vise grip with conveniences and easier operations in such a way to provide a vise function while providing a biting function of typical pliers without modifying a lot a conventional plier configuration.

It is another object of the present invention to provide vise grip pliers which have a good durability and convenience corresponding to a natural vise grip function implemented using a principle wherein an action direction of force is changed, and a recovering elastic force is limited after it has been expanded by a grip strength within an elastic limit of a material while providing a simplified configuration.

It is further another object of the present invention to provide vise grip pliers which make sure to provide a convenience in operation since a clamping function can be implemented through a simplified operation of a ring pin in response to a bitten object.

It is still further another object of the present invention to provide pliers which may provide a surface contact function and the function of jaws configured to grip stable even a small object without any slipping, while resolving the problems encountered in the conventional technology wherein when clamping a predetermined object using conventional pliers, the object is not gripped stable since the object is gripped through upper and lower point contacts and linear contacts and then the object slips forward or the clamped state becomes unstable in a gripping state, and when gripping an angular or slippery object is gripped, the corners thereof are damaged.

To achieve the above objects, there is provided vise pliers wherein first and second jaws are provided at a front end thereof, and upper and lower handle bodies of the pliers axially engaged crossing in an X-shape with the aid of a hinge pin are bent inward and then are bent again outward, by which a variation is provided to the direction of the grip strength of the handles at the inner sides of the bent portions, whereby the upper and lower handles consequently can form a second X-shaped cross.

A ring pin hole to which a ring pin is engaged, may be formed at an inner side between a first cross position and a second cross position corresponding to the position of a hinge shaft position.

When an object is clamped between the jaws, and a grip strength is applied to the first and second handles, the ring pin hole expands, and the sizes of the ring pin holes having different widths determined based on the size of the clamped object are set, and if the ring pin is rotated and fixedly inserted in a state where the grip strength has been applied, namely, the ring pin hole has been expanded, the first and second jaws may maintain the state where they have strongly bitten, thus implementing the function of the vise.

Since the ring pin which has been rotated and fixedly inserted, is preventing any contraction of the ring pin, the first and second handles will be no longer split wide, by which the clamping state of the jaws can continue.

The vertical direction thickness of the ring pin is smaller than the horizontal direction interval of the ring pin holes defined by the inner curved surface at the bent portion of each handle, so the ring pin is inserted between them and can rotate easily. To this end, it has a shape wherein the width of the radius can change variously with respect to the assembling hole which is formed eccentric, and the ring pin is assembled inserted in the body of the second handle at the position of the ring pin hole.

Meanwhile, the horizontal direction size of the ring pin hole can change minutely based on the positions of the handles, which is not involved in the use purpose of the pliers, and the horizontal direction thickness of the ring pin can be changed, which is not also involved in the manufacturing and assembling procedures.

If it needs to use the pliers for the sake of ordinary purposes, not for the sake of the vise function of the pliers, the thick portion may descend by the self-weight in a state where the thin portion of the ring pin has hung over the bent and curved portions, so the expansion and contraction extents of the ring pin hole can be much, which may allow for the function of the pliers.

In the present invention, The first and second handles are extended straight without bending them outward, as mentioned above, immediately behind the initial position of the hinge shaft, more specifically, the first handle which positions above, may be bent upward, and the second handle which positions below, may be bent downward, and then they are bent downward and upward which are opposite to the previous actions, after which the first and second handles can form the second and third X-shaped crosses.

Moreover, the two ring pin holes may be defined once between the hinge position and the second X-shaped cross and once again between the second and third X-shaped crosses, wherein the first ring pin hole may be fixed with the ring pin, but only the second ring pin hole, which is formed after the formation of the first one, may be fixed with the ring pin. In this way, the function of the vise grip pliers which are able to more strongly bite an object between the jaws, can be implemented.

The second ring pin hole may be formed larger than the first ring pin, by which the ring pin the maximum cross section width of which is larger, can be adapted.

Two or more than two (for example, three or four) of the elastically transformable cut-away holes may be preferably formed at the bent portions of the first and second handles, which are able to promote the expansion and contraction operations with respect to the pressing force within an elastic limit.

More elastic force may be provided to the expansion and contraction operations of the ring pin hole in such a way to, for example, split apart the bent portions and form a cut-away hole, whereby the clamping functions of the jaws can be more stably supported.

In the configuration of the jaws according to the present invention, the lower side thereof is formed flat, and the upper side thereof is formed curved from the end. The ends thereof may contribute to the typical function of the pliers. The surface of the lower jaw may surface-contact with the plane, and the upper jaw may contribute to, for example, pressing in the widened state, which makes it possible to stably support the plane.

When it needs to grip a glass, etc. having a high brittleness or grip a smooth wood, it is possible to more stably grip them after a board plank, etc. has been added at a portion contacting with the upper jaw.

Moreover, if the pliers are configured in such a way that the configurations of the first and second jaws are engaged superposed, a predetermined work can be implemented in a state where a small sized object is stably clamped.

Advantageous Effects of the Invention

In the present invention, the natural functions of the pliers and vies can be implemented through a simplified and improved structure, which makes it possible to provide an enhanced effect in terms of convenience when in use.

Moreover, since a simplified configuration which is not much different from the typical pliers, can be maintained, the manufacturing cost can be saved as compared to the conventional vies pliers which have complicated configurations.

BRIEF DESCRIPTION OF DRAWINGS

The present invention will become better understood with reference to the accompanying drawings which are given only by way of illustration and thus are not limitative of the present invention, wherein.

Figure 1:
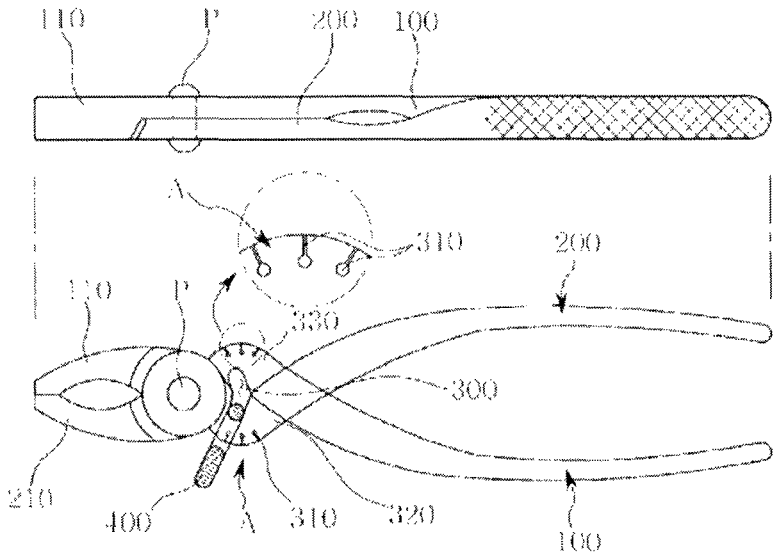
FIG. 1 is a view illustrating a plane configuration and a front side configuration according to a preferred embodiment of the present invention.

| Legends of reference numbers | |
|---|---|
| 100: | First handle |
| 110: | First jaw |
| 200: | Second handle |
| 210: | Second jaw |
| 300: | Ring pin hole (a space) away holes |
| 310, 320: | Elastically transformable cut- |
| 400: | Ring pin |
| 410: | Second ring pin |
| 450: | Eccentric assembling hole |
| 460: | Stop plate |

MODES FOR CARRYING OUT THE INVENTION

The present invention is referred to a combined use of a vise and pliers which can be implemented based on the use of a ring pin.

The present invention will be described with reference to the accompanying drawings.

Throughout the description of the present invention, the configuration and sizes of the components illustrated in the drawings may be simplified unless such simplifications are inferred with the descriptions of the present invention.

As illustrated in FIG. 1, the vise grip pliers according to the present invention may be configured in such a way that the pliers cross each other in a first X-shape as they are axially engaged through a hinge pin (P) through an axial hole formed at a body 330 of a first handle 100 at a front end of which a first haw 110 is provided and a body 320 of a second handle 200 wherein a second jaw 210 is provided, and then a ring pin hole 300 may be formed by means of a first bent part (A) wherein a second X-shaped cross is formed based on the second bending of the bodies 320 and 330 of the first and second handles, and a ring pin 400 having an eccentric circular hole or a stop plate one side surface of which is inclined, may be assembled, thus finishing pliers having a vise function.

The technical feature of the present invention is referred to a configuration wherein the first and second handles 100 and 200 may be connected at an axial point of the hinge pin (P) and are bent upward and downward, and different from the typical basic pliers, the first and second handles 100 and 200 cross each other in an X-shape through the second bending, which is referred to another bending after the first bending, so a ring pin hole 300 can be formed inward of the bent portions of the upper and lower handles between the first bent portions corresponding to the front and rear X-shaped crosses.

Figure 2:
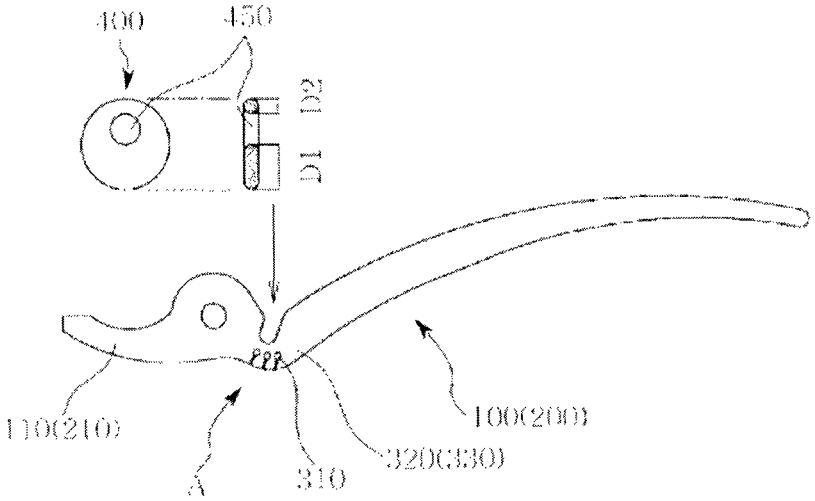
FIG. 2 is a view illustrating a plane configuration and a side configuration of a ring pin and an elastic cut-away hole according to the present invention.

As illustrated in FIG. 2, the second handle 200 or the first handle 100 may be assembled to the ring pin hole 300 through the hinge pin (P) in a state where the ring pin 400 or the stop plate 460 has been assembled at the rear end of the first handle 100 or the second handle 200.

In the ring pin hole 300, the ring pin 400 or the stop plate 460 may be assembled to the first bent part (A) of the bent portion. An eccentric assembling hole 450 may be formed at the ring pin 400 so as to have the maximum cross section width (D1) and the minimum cross section width (D2). It may be manufactured in a state where the portion having a larger cross section has been cut away. Thereafter, it can be assembled to the bent portion in such a way that the eccentric assembling hole 450 is expanded and contracted to cover the bent portion. The stop plate 460 may be formed in a trapezoid quadrangular plate shape wherein a quadrangular longitudinal hole is formed at an inner side thereof, and one side surface is inclined. The pliers may be assembled for the first or second handle 100 or 200 to be installed at the longitudinal hole in a state where the inclined one side surface is placed at the ring pin hole 300. The first or second handle 100 or 200 is set to be movable in the longitudinal hole of the stop plate 460, so any of the maximum cross section width or the minimum cross section width of the stop plate 460 can position at the ring pin hole 300, by which the hinge rotation ranges of the first and second handles 100 and 200 will be limited.

The first bent part (A) of the first and second handles 100 and 200 may be provided with two or more than two (three or four) of the elastically transformable cut-away holes 310 which can be elastically transformed with respect to the pressing force.

The thickness of the ring pin 400 may be thinner than the interval between the ring pin holes 300 formed at the first bent part (A), and the ring pin 400 may be formed in a circular ring shape for the sake of free rotations after the assembling. The longitudinal hole of the stop plate 460 is formed large enough for the first bent part (A) to move.

Figure 3:
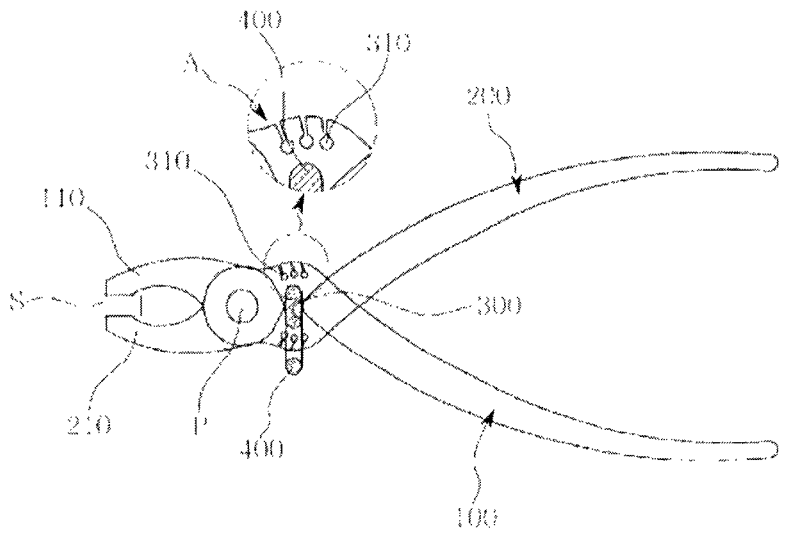
FIG. 3 is an operation view for describing a use state of a vise grip according to the present invention.

As illustrated in FIG. 3, the ring pin 400 is rotated about the eccentric assembling hole 450, and when the rotation stops at a position which may match with the current size of the ring pin hole in a state where a predetermined size object has been clamped, the ring pin hole no longer contracts, so the splitting of the handles can be limited, thus implementing a clamped state.

In a state where the elastically transformable cut-away holes 310 formed at the first bent part (A) expand, and the ring pin 400 is accommodated in the ring pin hole 300, if the pressed states of the first and second handles 100 and 200 are removed, the expanded state of the elastically transformable cut-away hole 310 may contract back to its initial state, by which the state where the ring pin hole 300 has bitten the ring pin 400 can be more stably fixed.

In a state where the ring pin 400 has been rotated about the circular eccentric hole and with the maximum cross section width (D1) having the widest width and the minimum cross section width (D2) having the narrowest width and has been fixed in response to the current size of the ring pin hole 300, the hinge rotations of the first and second handles 100 and 200 are inevitably limited, through which the vise grip function can be implemented.

Figure 4:
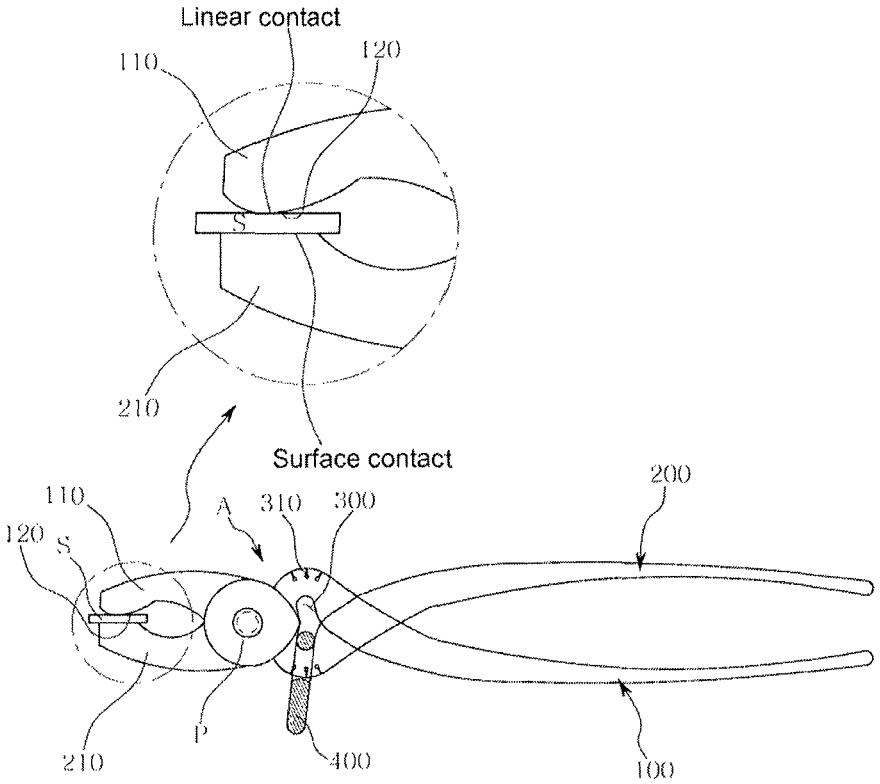
FIG. 4 is a view illustrating a modified example of a jaw according to another embodiment of the present invention.

FIG. 4 is a view illustrating a modified example of a jaw according to another embodiment of the present invention. A biting surface of the second jaw 110 of the second handle 200 is formed of a rounded surface 12 which is rounded from an end to the inner side, and the upper and lower surfaces of the flat object can have a surface contact at its lower side, and the upper side thereof is provided with a pressing in a linear contact state in the curved shape, is thus implementing a clamping operation wherein the object can be clamped stable.

Not illustrated in the drawings, the rounded surface 120 may be provided with a horizontal surface formed as long as a predetermined distance from the end to the inner side.

Figure 8:
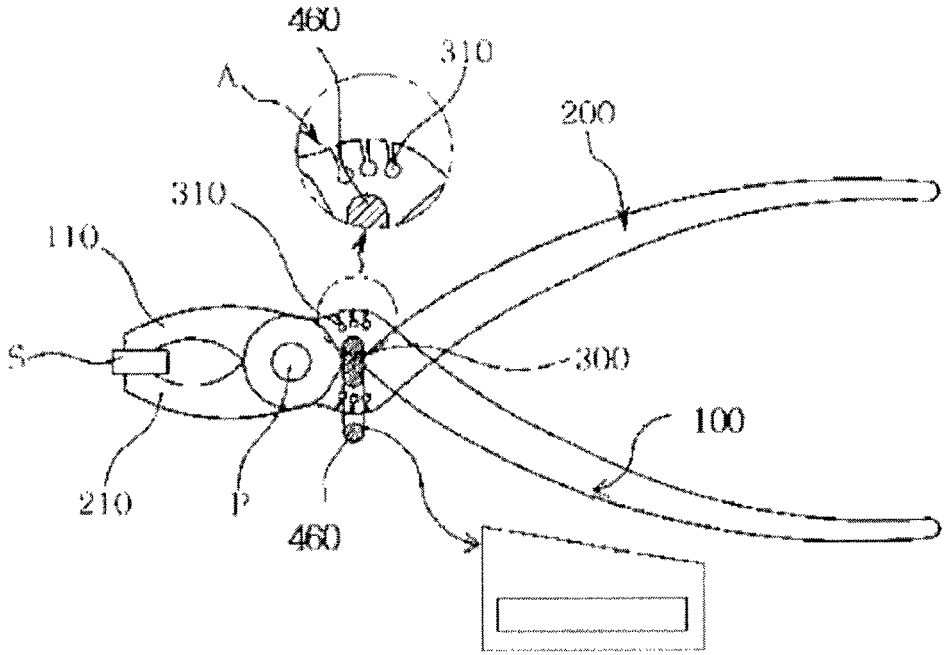
FIG. 8 is an operation view for describing a use state of a vise grip according to the present invention, wherein a stop plate is assembled.

As illustrated in FIG. 8, the longitudinal hole of the stop plate 460 may move over the first bent part (A). When the movement stops where it fits to the current size of the ring hole in a state where a predetermined size object has been clamped, since the ring pin hole no longer contracts, the splitting of the handles can be limited, by which the clamping state can be implemented.

In a state where the elastically transformable cut-away hole 310 formed at the first bent part (A) expands, and the stop plate 460 is accommodated in the ring pin hole 300, if the pressed state of the handles 100 and 200 is removed, the expanded state of the elastically transformable cut-away hole 310 recovers back to its initial state, and the state where the ring pin hole 300 has bitten the stop plate 460, can be fixed more stable.

In a state where the stop plate 460 has the maximum cross section width having the widest width and the minimum cross section width having the narrowest width, and the stop plate 460 moves over the first bent part (A) along the longitudinal hole of the stop plate 460 and is inserted matching with the current size of the ring pin hole 300, the hinge rotation of the first and second handles 100 and 200 are inevitably limited, by which the vise grip function can be implemented.

Figure 5A:
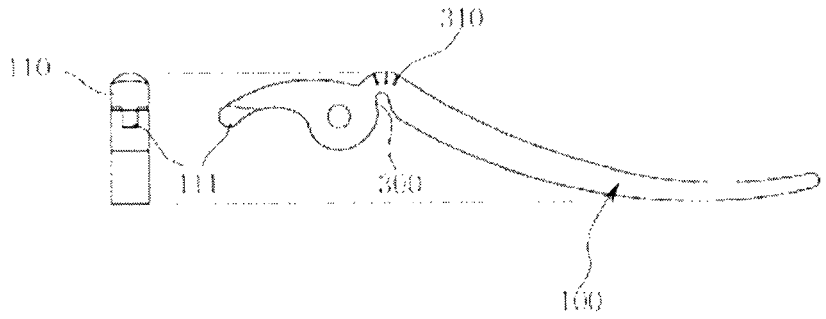
FIGS. 5A and 5B are views illustrating a side configuration and a front side configuration of a modified example of a jaw according to another embodiment of the present invention.
Figure 5B:
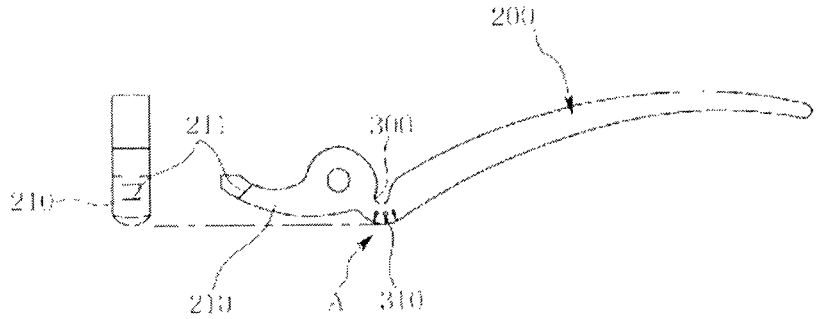
Figure 6:
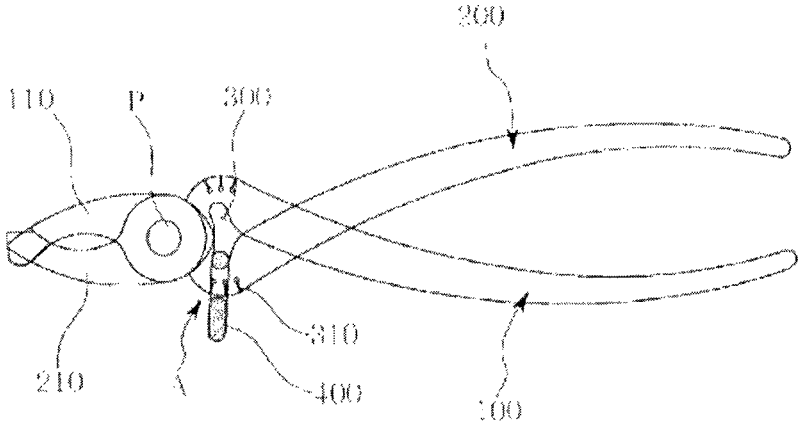
FIG. 6 is a front view illustrating a state where the configurations in FIGS. 5A and 5B are engaged with each other.

As illustrated in FIGS. 5A, 5B and 6, the first jaw 110 of the first handle 100 and the second jaw 210 of the second handle 200 may be configured in a male and female structure where there can be clamped as a protrusion 111 and a groove 211 are engaged with each other.

In this embodiment, it is possible to stably clamp a small sized object, for example, a needle, etc.

Figure 7:
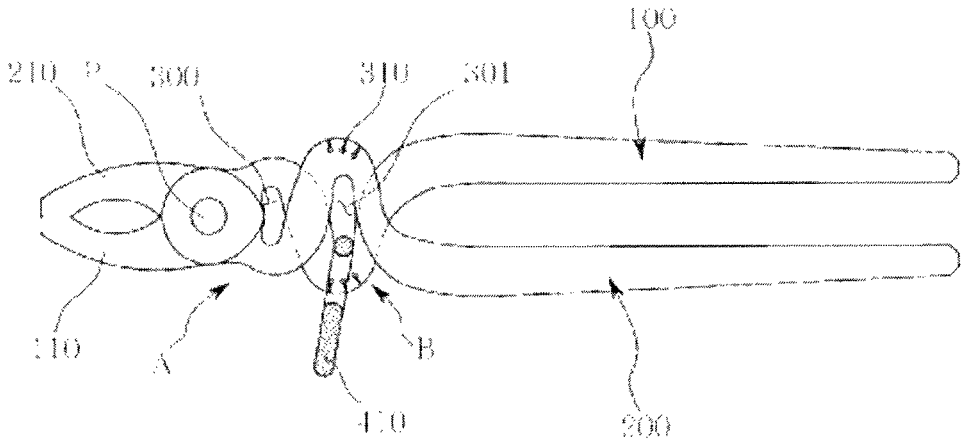
FIG. 7 is a front view according to further another embodiment of the present invention.

FIG. 7 is a view of another embodiment of the present invention, wherein the handles are straight extended without bending them outward immediately after the initial hinge shaft engaging and crossing of the handles, and then the handles are bent inward, thus forming a first bent part (A), and then they are bent in the opposite direction, thus forming a second bent part (B). Consequently, three X-shaped crossing can be obtained including the hinge, and two ring pin holes 300 and 301 can be formed.

A thicker ring pin 410 having a different standard from the ring pin 400 adapted to the first example may be assembled to the second ring pin hole 301. The elastic cut-away hole of the first bent part (A) is meaningless, and the contraction and expansion directions of the ring pin hole 300 are not related with, for example, an actual use purpose, for which a processing is not necessary, and it is natural that an elastically transformable cut-away hole 320 which may be elastically transformed with respect to the pressing force can be processed and formed.

In this embodiment, since it is far from the hinge formed at the bodies of the first and second handles 100 and 200, the rotation radius thereof is wider than the first bent part (A), so the contracting force applied to the ring pin may increase within the range of elasticity, by which the object can be more strongly bitted.

While the preferred embodiments of the present invention have been described, the present invention is not limited thereto, and it is obvious that the embodiments can be modified in various ways without departing apart from the technical principles of the present invention.

For example, except for the above descriptions, the engaging surfaces of the first and second jaws 110 and 210 of the first and second handles 100 and 200 may be formed into various cross sections based on the specific shapes of the processing object (S).

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The present invention is expected to greatly increase the work efficiency when it needs to carry out a processing work after a processed object has been stably fixed at a production field of various industrial products, a laboratory of a research center, etc., and the present invention may be usefully used at various production fields and research centers.

INDUSTRIAL APPLICABILITY

The present invention is expected to greatly increase the work efficiency when it needs to carry out a processing work after a processed object has been stably fixed at a production field of various industrial products, a laboratory of a research center, etc., and the present invention may be usefully used at various production fields and research centers.

The invention claimed is:

1. Vise grip pliers, comprising:

first and second handles which include first and second jaws at their front ends and are engaged crossing each other in a X-shape through a hinge pin, wherein in the first and second handles, a ring pin or a stop plate is assembled in such a way that a ring pin hole is formed at an inner side of a first bent part formed crossing in an X-shape by means of a second bending which is carried out after a first bending wherein the first and second handles are connected to an axial point of the hinge pin and are bent upward and downward, and the first and second handles are configured in such a way that the clamping of the first and second jaws can be fixed by any cross section width between the minimum and maximum cross section widths of the ring pin or the stop plate.

2. The pliers of claim 1, wherein the ring pin is a circular ring having an outer diameter corresponding to the inner diameter of a ring pin hole formed at the first bent part and is eccentrically assembled to the first or second handle, and the rotation ranges of the first and second handles are limited as any cross section width between the maximum cross section width and the minimum cross section width of the ring pin positions at the ring pin hole based on the rotation by an eccentric assembling hole.

3. The pliers of claim 2, wherein in a state where the maximum cross section width of the ring pin or the stop plate is bitten by the ring pin hole formed at the first bent part of the first or second handle, the removal of the clamped state of the first and second handles is inhibited.

4. The pliers of claim 1, wherein the stop plate has a quadrangular longitudinal hole at an inner side thereof and is formed like a quadrangular plate in a trapezoid shape one side surface of which is formed inclined, and the first or second handle is installed assembled to the longitudinal hole for the inclined one side surface to position at the ring pin hole, and the first or second handle is disposed movable in the longitudinal hole of the stop plate, and as any cross section width between the maximum cross section width and the minimum cross section width of the stop plate positions at the ring pin hole, the hinge rotation ranges of the first and second handles can be limited.

5. The pliers of claim 4, wherein in a state where the maximum cross section width of the ring pin or the stop plate is bitten by the ring pin hole formed at the first bent part of the first or second handle, the removal of the clamped state of the first and second handles is inhibited.

6. The pliers of claim 1, wherein the first and second handles are re-bent at the first bent part, thus forming a second bent part wherein a second ring pin hole more expanded than the ring pin hole is formed, and the second ring pin hole is formed larger than the ring pin hole, and a second ring pin having the maximum cross section width larger than the ring pin is assembled.

7. The pliers of claim 6, wherein three or four elastically transformable cut-away holes are formed at the first and second bent parts of the first and second handles, wherein the elastically transformable cut-away holes can be elastically transformed with respect to a pressing force.

8. The pliers of claim 1, wherein three or four elastically transformable cut-away holes are formed at the first and second bent parts of the first and second handles, wherein the elastically transformable cut-away holes can be elastically transformed with respect to a pressing force.

9. The pliers of claim 1, wherein the biting surface of the second jaw is formed flat with respect to the biting parts of the first and second jaws, and the biting surface of the first jaw are formed curved inward from the end thereof, and when biting, the plane of the second jaw keeps a surface contact state, and the first jaw is able to bite through a linear contact.

10. The pliers of claim 1, wherein the first jaw of the first handle and the second jaw of the second handle are configured in a male and female structure, wherein the clamping can be implemented as a protrusion and a groove are engaged with each other.

* * * * *